US006802697B2

(12) United States Patent
Hu

(10) Patent No.: US 6,802,697 B2
(45) Date of Patent: Oct. 12, 2004

(54) VARIABLE-DELIVERY, FIXED-DISPLACEMENT PUMP

(75) Inventor: Haoran Hu, Novi, MI (US)

(73) Assignee: Caterpillar Inc, Peoria, IL (US)

( * ) Notice: Subject to any disclaimer, the term of this patent is extended or adjusted under 35 U.S.C. 154(b) by 34 days.

(21) Appl. No.: 10/331,167

(22) Filed: Dec. 30, 2002

(65) Prior Publication Data

US 2004/0123839 A1 Jul. 1, 2004

(51) Int. Cl.[7] ..... F04B 27/08; F04B 49/00

(52) U.S. Cl. ..... 417/53; 123/506; 123/446; 417/270; 417/283

(58) Field of Search ..... 417/53, 270, 283, 417/295, 298; 92/71; 123/506, 446

(56) References Cited

U.S. PATENT DOCUMENTS

| | | | | |
|---|---|---|---|---|
| 2,433,222 | A | 12/1947 | Huber | |
| 2,464,448 | A | 3/1949 | Huber | |
| 2,512,799 | A | 6/1950 | Huber | |
| 2,517,008 | A | 8/1950 | Marshall et al. | |
| 2,562,615 | A | 7/1951 | Huber | |
| 2,664,047 | A | 12/1953 | Huber | |
| 2,732,805 | A | 1/1956 | Lucien | |
| 2,778,314 | A | 1/1957 | Siver | |
| 2,982,216 | A | 5/1961 | Huber | |
| 2,997,956 | A | 8/1961 | Stewart | |
| 3,016,018 | A | 1/1962 | Williams | |
| 3,016,837 | A | 1/1962 | Dlugos | |
| 3,020,847 | A | 2/1962 | Rohrberg | |
| 3,236,189 | A | 2/1966 | Pasker | |
| 5,603,609 | A | 2/1997 | Kadlicko | |
| 6,035,828 | A | 3/2000 | Anderson et al. | |
| 6,216,670 | B1 | 4/2001 | Anderson et al. | |
| 6,264,437 | B1 | 7/2001 | Porel | |
| 6,644,277 | B2 * | 11/2003 | Blass et al. | 123/446 |
| 6,648,605 | B2 * | 11/2003 | Nelson | 417/53 |

* cited by examiner

*Primary Examiner*—Charles G. Freay
(74) *Attorney, Agent, or Firm*—Finnegan, Henderson, Farabow, Garrett & Dunner

(57) ABSTRACT

A pump includes a pump housing, a rotating shaft extending through the pump housing, a plurality of pistons, and a plurality of control sleeves. Each piston may be at least partially, slidably contained within a respective piston sleeve. The pistons may also be be operably coupled to the rotating shaft such that rotation of the shaft rotates and reciprocates the pistons. Each control sleeve may be slidably disposed on a respective one of said piston sleeves and operable to selectively vary the amount of fluid delivered by the pump.

20 Claims, 3 Drawing Sheets

VARIABLE-DELIVERY, FIXED-DISPLACEMENT PUMP

TECHNICAL FIELD

This invention relates generally to hydraulically-actuated systems used with internal combustion engines, and more particularly to a variable-delivery, fixed-displacement pump of a high pressure hydraulically-actuated system.

BACKGROUND

Axial piston pumps are known to be used in hydraulically-actuated fuel injection systems. The efficient operation of such pumps is significant to the overall operation of the engine. Moreover, the ability of such pumps to operate free of maintenance is important to reduce downtime of the system.

U.S. Pat. No. 6,035,828 to Anderson et al. describes a fixed displacement, variable delivery axial piston pump for a hydraulically-actuated fuel injection system. In the Anderson et al. system, a high pressure common rail supplies hydraulic fluid to a plurality of hydraulically-actuated fuel injectors mounted in a diesel engine. The hydraulic fluid received in the common rail is pressurized by the fixed displacement axial piston pump that is driven directly by the engine. The pump includes a plurality of pistons disposed in parallel about the central longitudinal axis of the pump, and reciprocation of the pistons is achieved by the rotation of an angled camming surface or swash plate that is biased against a proximal end of the pistons. Displacement of the pump is varied by a control actuator that selectively varies the amount of pressurized fluid supplied to the pump outlet during the discharge stroke of each piston.

While the Anderson et al. pump performs well in operation, the amount of fluid pushed through the check valve to the common rail is varied by allowing leakage of pressurized fluid from the pumping chamber via spill ports. Some of the work used to pressurize the fluid in the pumping chamber is eventually lost through this leakage of fluid through the spill ports. Also, the sleeves that selectively block the spill ports have a reciprocation distance that may require an expensive actuator. The reciprocation of the sleeves may also lead to failure of the sleeves or other associated components that requires maintenance or replacement.

The present invention provides an axial piston pump that avoids some or all of the aforesaid shortcomings in the prior art.

SUMMARY OF THE INVENTION

In accordance with one aspect of the invention, a pump includes a pump housing, a rotating shaft extending through the pump housing, a plurality pistons, and a plurality of control sleeves. Each piston may be at least partially, slidably contained within a respective piston sleeve. The pistons may also be operably coupled to the rotating shaft such that rotation of the shaft rotates and reciprocates the pistons. Each control sleeve may be slidably disposed on a respective one of the piston sleeves and operable to selectively vary the amount of fluid delivered by the pump.

According to another aspect of the present invention, a method of delivering an amount of pressurized fluid from a pump includes reciprocating a plurality of pistons in a plurality of respective piston sleeves through a retracting stroke and a compression and delivery stroke. The method also includes operably moving a control sleeve to selectively vary a flow of fluid through a sleeve port in the piston sleeve during the retracting stroke so as to vary the amount of fluid delivered by the pump.

According to yet another aspect of the present invention, a hydraulically actuated system includes a pump including a rotating shaft, a plurality pistons, and a plurality of control sleeves. Each piston may be at least partially, slidably contained within a respective piston sleeve, and the pistons may be operably coupled to the rotating shaft such that rotation of the shaft rotates and reciprocates the pistons. Each control sleeve may be slidably disposed on a respective one of the piston sleeves and being operable to selectively vary the amount of fluid delivered by the pump. The system also includes a high pressure rail connected to the pump, at least one hydraulically actuated fuel injector connected to the high pressure rail, and an electronic control module configured to control the control sleeves.

It is to be understood that both the foregoing general description and the following detailed description are exemplary and explanatory only and are not restrictive of the invention.

DETAILED DESCRIPTION

Reference will now be made in detail to the exemplary embodiments of the invention, examples of which are illustrated in the accompanying drawings. Wherever possible, the same reference numbers will be used throughout the drawings to refer to the same or like parts.

Figure 1:
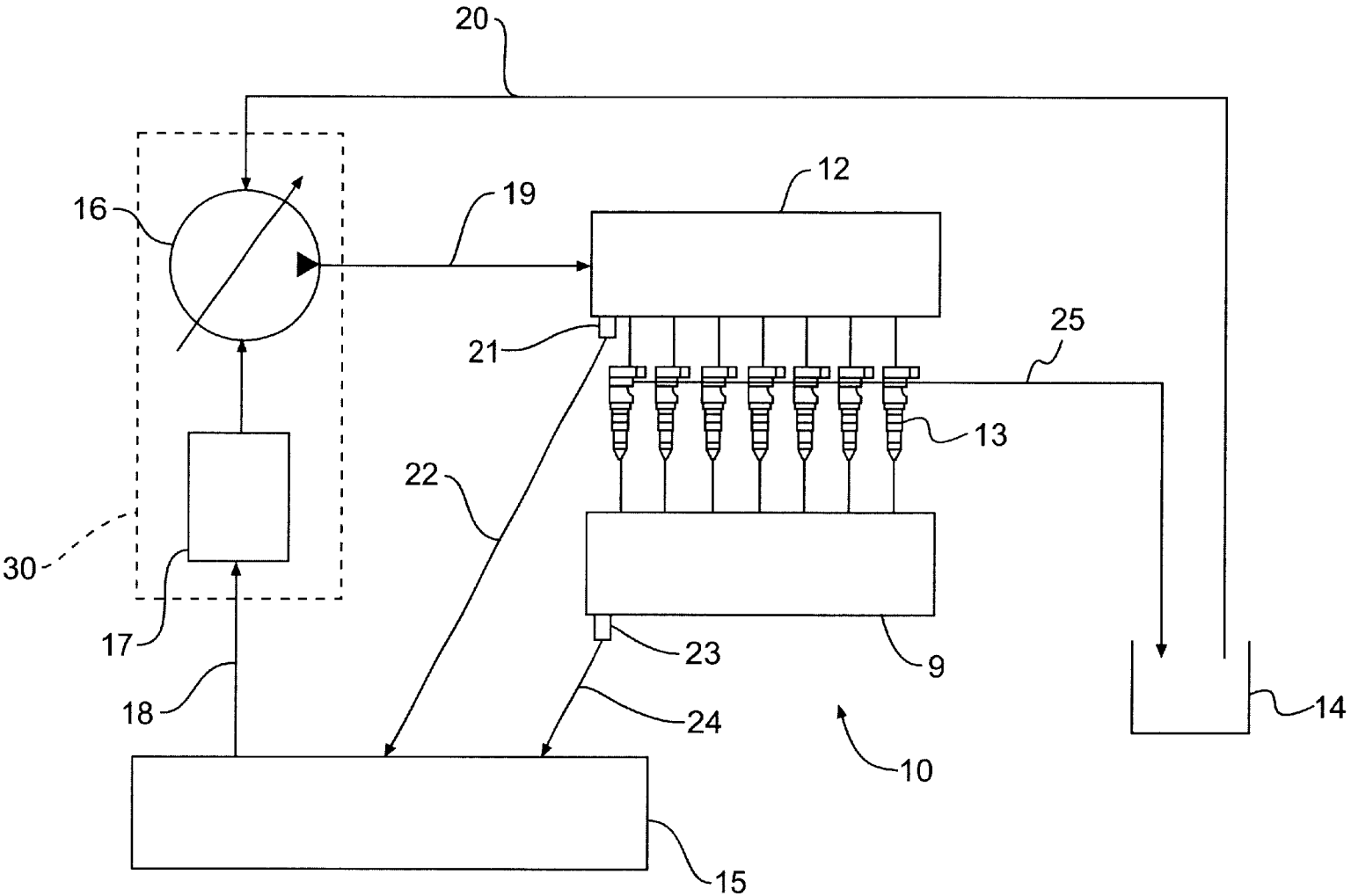
FIG. 1 is a schematic illustration of a hydraulically-actuated fuel injection system according to an exemplary embodiment of the present invention.

Referring now to FIG. 1, a hydraulically actuated system 10 is associated with an internal combustion engine 9. The hydraulic system 10 includes a high pressure common fluid rail 12 that supplies high pressure actuation fluid to a plurality of hydraulically-actuated devices, such as hydraulically-actuated fuel injectors 13. Those skilled in the art will appreciate that other hydraulically-actuated devices, such as actuators for gas exchange valves for exhaust brakes, could be substituted for the fuel injectors 13 illustrated in the exemplary embodiment. The common rail 12 is pressurized by a variable-delivery, fixed-displacement pump 16 via a high pressure supply conduit 19. The pump 16 draws actuation fluid along a low pressure supply conduit 20 from a source of low pressure fluid, for example, the engine's lubricating oil sump 14. It should be appreciated that other available liquids could be used. After the high pressure fluid does work in the individual fuel injectors 13, the actuating fluid is returned to sump 14 via a drain passage 25.

The engine 9 may also include a controller, for example, an electronic control module 15. As is well known in the art, the desired pressure in the common rail 12 may be a function of one or more engine operating conditions. For instance, at high speeds and loads, the rail pressure may be desired to be significantly higher than the desired rail pressure when the engine is operating at an idle condition. An operating condition sensor 23 may be operably attached to the engine 9 and may periodically provide the electronic control module 15 with sensor data, which may include, for example, engine speed and load conditions, via a communication line 24. In addition, a pressure sensor 21 may periodically provide the electronic control module 15 with the measured fluid pressure in the common rail 12 via a communication line 22. The electronic control module 15 may compare a desired rail pressure, which is a function of the one or more engine operating conditions, with the actual rail pressure provided by the pressure sensor 21.

If the desired and measured rail pressures are different, the electronic control module 15 may command movement of a control actuator 17 via a communication line 18. The position of the control actuator 17 determines the amount of fluid that leaves the pump 16 via the high pressure supply conduit 19 to the high pressure rail 12. Both the control actuator 17 and the pump 16 may be contained in a single pump housing 30. Pressure in the common rail 12 may be controlled by controlling the delivery output from the pump 16, rather than by wasting energy through the drainage of pressurized fluid from the common rail 12 in order to achieve a desired pressure.

Figure 2:
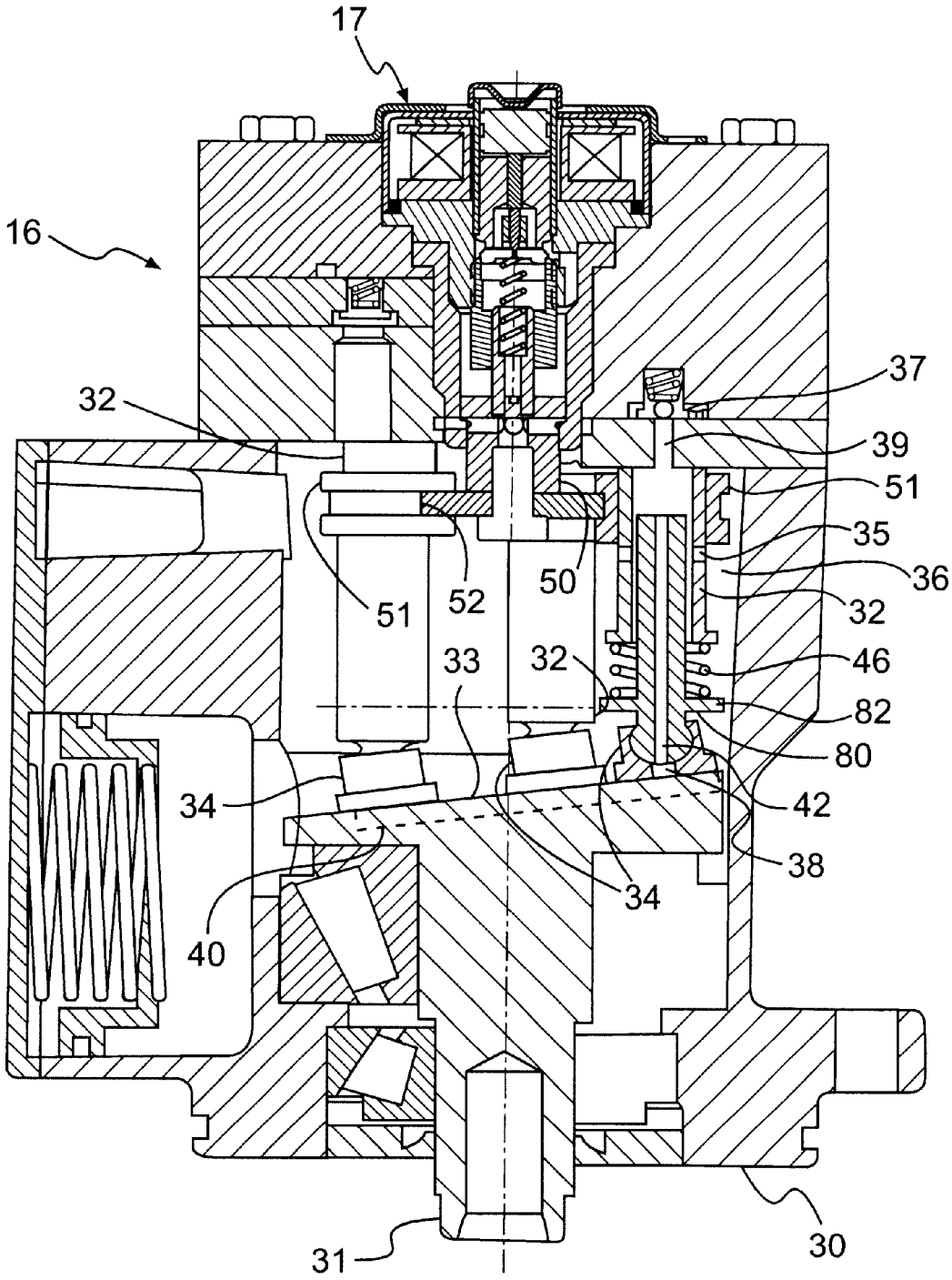
FIG. 2 is a cross-section diagrammatic view of an axial piston pump according to an exemplary embodiment of the present invention.

Referring now to FIG. 2, the pump 16 may include a rotating shaft 31 that is coupled directly to the output of the engine 9, for example, the drive shaft (not shown), such that the rotation rate of shaft 31 is directly proportional to the rotation rate of the drive shaft of the engine 9. A fixed angle swash plate 33 is attached to the shaft 31. The pump 16 includes a plurality of pistons 80 disposed in parallel, each slidable in an associated piston sleeve 32. Each piston 80 is urged toward the swash plate 33 by a return spring 46 disposed between the piston sleeve 32 and a flange 82 of the piston 80, such that rotation of the swash plate 33 causes reciprocation of the pistons 80. For example, the pump 16 may include five pistons 80 that are continuously urged toward the swash plate 33 by the return springs 46. Each piston 80 includes a piston passage 42 extending longitudinally through the piston 80.

Each piston sleeve 32 includes at least one sleeve port 35 arranged to selectively permit fluid communication between a low pressure area 36 and a pumping chamber 39. The low pressure area 36 contains the low pressure fluid supplied by the lubricating oil sump 14. The pumping chamber 39 contains pressurized fluid being displaced from the pump 16 to the common rail 12.

The return springs 46 maintain shoes 34, which are coupled with one end of each piston 80, in contact with the swash plate 33 in a conventional manner. Each shoe 34 includes a shoe port 38 associated with a corresponding piston passage 42. The swash plate 33 may include a swash plate conduit 40 arranged to provide fluid communication between the low pressure area 36 and the piston passage 42, via the shoe port 38.

Because the swash plate 33 has a fixed angle, the pistons 32 reciprocate through a fixed reciprocation distance with each rotation of the shaft 31. Thus, the pump 16 can be thought of as a fixed displacement pump. However, as is will be described in more detail below, the control actuator 17 may be operated to vary the amount of fluid being pushed past a check valve 37 into a high pressure area (not shown) and on to the common rail 12.

The amount of fluid displaced by the pistons 32 to respective high pressure areas (not shown) and on to the high pressure common fluid rail 12 is determined by the position of the control sleeves 51 that are movably mounted on the outer surface of the piston sleeves 32. Each control sleeve 51 is connected to move with a central actuator shaft 50 via an annulus 52. The actuator shaft 50 moves between a first position at which the control sleeve 51 allows fluid flow between the low pressure area 36 and the pumping chamber 39 via the sleeve port 35 and a second position at which the control sleeve 51 blocks fluid flow between the low pressure area 36 and the pumping chamber 39 via the sleeve port 35.

Figure 3A:
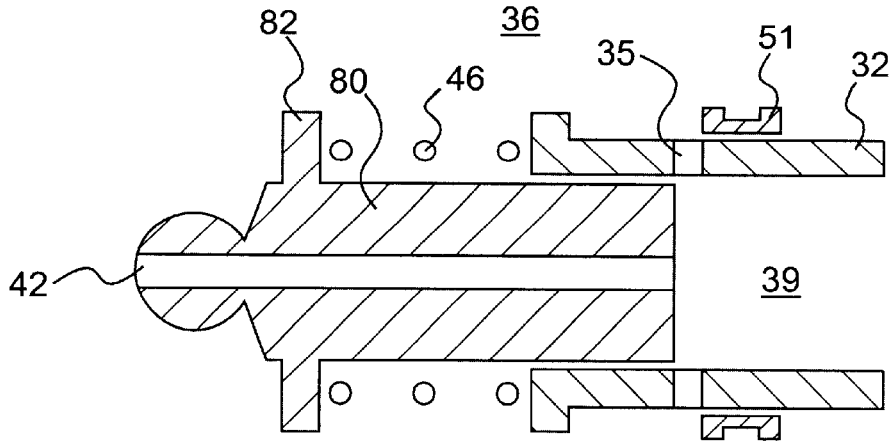
FIGS. 3A–3C are diagramatic illustrations of the control sleeve of the fixed displacement pump of FIG. 2.
Figure 3B:
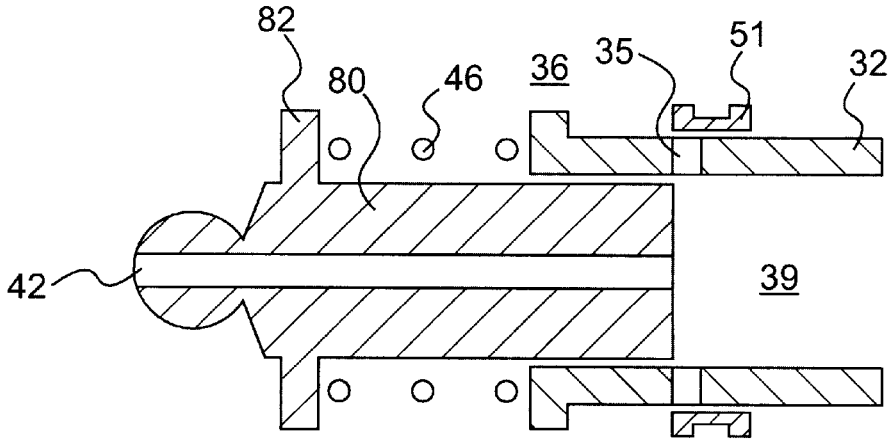
Figure 3C:
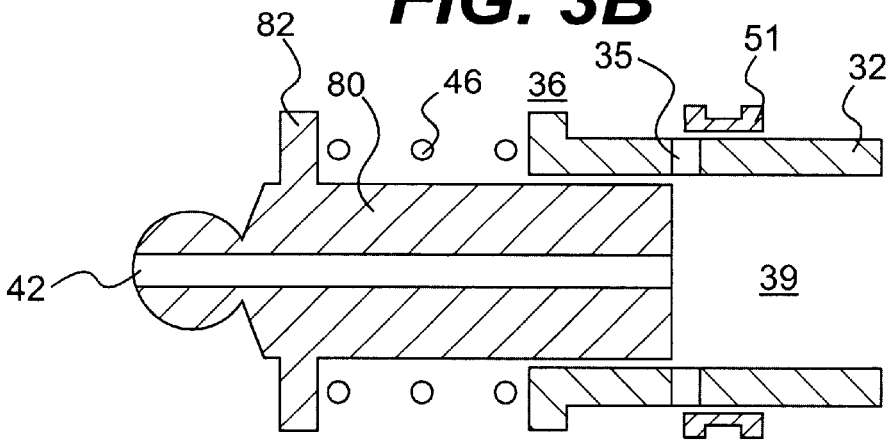

FIG. 3A illustrates the control sleeve 51 in a position allowing fluid flow between the low pressure area 36 and the pumping chamber 39 via the sleeve port 35 during a retracting stroke of the piston 80. FIG. 3B illustrates the control sleeve 51 in a position blocking substantially all fluid flow between the low pressure area 36 and the pumping chamber 39 via the sleeve port 35 during a retracting stroke of the piston 80. FIG. 3C illustrates the control sleeve 51 in a position partially blocking fluid flow (and partially allowing fluid flow) between the low pressure area 36 and the pumping chamber 39 via the sleeve port 35 during a retracting stroke of the piston 80.

Industrial Applicability

In operation, the piston 80 reciprocated through a retracting stroke and a compression and delivery stroke by rotation of the rotating shaft 31 and swash plate 33. The pump 16 draws an amount of fluid into the pumping chamber 39 during the retracting stroke of the piston 80 and pushes the fluid past the check valve 37 to a high pressure area in fluid communication with the common rail 12 during the compression and delivery stroke of the piston 80.

During the compression and delivery stroke of the piston 80, the piston passage 42 and the shoe port 38 of the piston 80 are not in fluid communication with the low pressure area 36 via the swash plate conduit 40. Also during the compression and delivery stroke, as shown in FIG. 2, fluid flow between the low pressure area 36 and the pumping chamber 39 via the sleeve port 35 is blocked by the piston 80.

With fluid flow through the piston passage 42 and the sleeve port 35 blocked, pressure under each piston 32 builds within the corresponding pumping chamber 39 during the compression and delivery stroke. As the pressure builds in the pumping chamber 39, the fluid displaced by the piston 80 is pushed past the check valve 37 into a high pressure area connecting the annulus 52 and eventually to the high pressure rail 12.

During the retracting stroke of the piston 80, fluid is permitted to flow from the low pressure area 36 to the pumping chamber 39 via the piston passage 42 and/or the sleeve port 35. The amount of fluid pushed past the check valve 37 may be varied by varying the amount of fluid flowing from the low pressure area 36 to the pumping chamber 39 during the retracting stroke of the piston 80. For example, the shoe port 38, the swash plate conduit 40, and the piston passage 42 may be structured and arranged to allow a rate of fluid flow that prevents cavitation in the piston passage 42 and to provide a desired amount of fluid to the pumping chamber 39 during idle operation of the engine 9. The one or more sleeve ports 35 may be structured and arranged to allow a rate of fluid flow and to provide an amount of fluid to the pumping chamber such that, together with the amount of fluid provided via the piston passage 42, the pump 16 can function at its full-load, rated operation.

Referring now to FIG. 3A, an exemplary operation of the control sleeve 51 during full-load operation of the engine 9 is illustrated. The control sleeve 51 is positioned so as to allow fluid flow between the low pressure area 36 and the pumping chamber 39 via the sleeve port 35. This position of the control sleeve 51 may be attained, for example, when the control actuator 17 is not actuated. Fluid flow between the low pressure area 36 and the pumping chamber 39 is also permitted through the piston passage 42 via the swash plate conduit 40 and the shoe port 38.

An exemplary operation of the control sleeve 51 during idle operation of the engine 9 is depicted in FIG. 3B. The control sleeve 51 is positioned so as to block substantially all fluid flow between the low pressure area 36 and the pumping chamber 39 via the sleeve port 35. This position of the control sleeve 51 may be attained, for example, when the control actuator 17 is actuated to its maximum stroke. Fluid flow between the low pressure area 36 and the pumping chamber 39 is permitted through the piston passage 42 via the swash plate conduit 40 and the shoe port 38.

FIG. 3C shows an exemplary operation of the control sleeve 51 during part-load operation of the engine 9. The control sleeve 51 is positioned so as to only partially block fluid flow between the low pressure area 36 and the pumping chamber 39. This position of the control sleeve 51 may be attained, for example, when the control actuator 17 is actuated to a stroke less than its maximum stroke. The degree of actuation of the control actuator 17 may be controlled by the electronic control module 15 in response, for example, to feedback from the pressure sensor 21 or the engine operation condition sensor 23. Fluid flow between the low pressure area 36 and the pumping chamber 39 is also permitted through the piston passage 42 via the swash plate conduit 40 and the shoe port 38.

The present invention reduces the travel distance of the control sleeve 51 between idle operation of the engine 9 and full-load operation of the engine 9. Decreasing the travel distance of the control sleeve 51 reduces the stroke of the actuator shaft 50. Thus, a lower capacity and less expensive control actuator 17 may be used. Also, the amount of fluid pushed past the check valve 37 is varied by varying the amount of fluid allowed into the pumping chamber 39 before compression, rather than by allowing leakage of fluid after compression. Therefore, the amount of work performed by the piston 80 may be reduced, the amount of work wasted by the pump 16 may be reduced, and the efficiency of the pump may be increased. Further, minimizing the travel of the control sleeve 51 and the stroke of the actuator shaft 50 may reduce the wear and tear on these elements, thereby minimizing maintenance time and costs.

It will be apparent to those skilled in the art that various modifications and variations can be made in the disclosed variable-delivery, fixed-displacement pump without departing from the scope of the present disclosure. Other embodiments of the variable-delivery, fixed-displacement pump will be apparent to those skilled in the art from consideration of the specification and practice of the device disclosed herein. It is intended that the specification and examples be considered as exemplary only.

What is claimed is:

1. A pump comprising:

a pump housing;

a rotating shaft rotatably connected to the pump housing;

a plurality of pistons, each piston at least partially, slidably contained within a respective piston sleeve, the pistons being operably coupled to the rotating shaft such that rotation of the shaft reciprocates the pistons; and a plurality of control sleeves, each control sleeve being slidable relative to a respective one of said piston sleeves and being operable to selectively vary the amount of fluid delivered by the pump.

2. The pump according to claim 1, further including a control actuator configured to operably control the control sleeves.

3. The pump according to claim 2, wherein an area of the pump housing contains low pressure fluid.

4. The pump according to claim 3, wherein each piston and respective piston sleeve cooperate to at least partially define a pumping chamber.

5. The pump according to claim 4, wherein each piston sleeve includes at least one sleeve port configured to selectively provide fluid communication between the area of the housing containing low pressure fluid and the pumping chamber.

6. The pump according to claim 5, wherein the control actuator is operable to move each of the control sleeves between a first position allowing unrestricted fluid flow between the area of the housing containing low pressure fluid and the pumping chamber via the at least one sleeve port and a second position at least partially blocking fluid flow between the area of the housing containing low pressure fluid and the pumping chamber via the at least one sleeve port.

7. The pump according to claim 6, wherein each piston includes a piston passage extending through a length of the piston.

8. The pump according to claim 7, wherein said piston passage selectively provides fluid communication between the area of the housing containing low pressure fluid and the pumping chamber.

9. The pump according to claim 8, wherein said rotating shaft is configured to reciprocate each of said pistons through a retracting stroke and a compression and delivery stroke.

10. The pump according to claim 9, wherein the piston passage is configured to direct an amount of fluid from the area of the housing containing low pressure fluid to the pumping chamber during said retracting stroke to correspond with an idle operation of an internal combustion engine.

11. The pump according to claim 10, wherein the at least one sleeve port of each piston sleeve is configured to direct an amount of fluid from the area of the housing containing low pressure fluid to the pumping chamber during said retracting stroke to correspond with a full-load operation of the internal combustion engine.

12. The pump according to claim 11, wherein the control actuator is configured to move the control sleeves to at least partially block said at least one sleeve port of each piston sleeve to at least partially block fluid flow from the area of the housing containing low pressure fluid to the pumping chamber during said retracting stroke to correspond with a part-load operation of the internal combustion engine.

13. The pump according to claim 12, further including an electronic control module configured to control said control actuator in response to a sensed pressure at a high pressure rail in fluid communication with the pump.

14. A method of delivering an amount of pressurized fluid from a pump, comprising:

reciprocating a plurality of pistons in a plurality of respective piston sleeves through a retracting stroke and a compression and delivery stroke; and operably moving a control sleeve to selectively vary a flow of fluid through a sleeve port in the piston sleeve during the retracting stroke so as to vary the amount of fluid delivered by the pump.

15. The method of claim 14, further including providing fluid communication between an area containing low pressure fluid and a pumping chamber via a piston passage extending through a length of the piston, the piston passage being configured to direct an amount of fluid from the area containing low pressure fluid to the pumping chamber during said retracting stroke to correspond with an idle operation of an engine.

16. The method of claim 15, further including controlling the control sleeve to allow fluid flow through the at least one sleeve port of at least one piston sleeve to direct an amount of fluid from the area containing low pressure fluid to the pumping chamber during said retracting stroke to correspond with a full-load operation of the engine.

17. The method of claim 16, further including controlling the control sleeve to at least partially block said at least one sleeve port of at least one piston sleeve to at least partially block fluid flow from the area containing low pressure fluid to the pumping chamber during said retracting stroke to correspond with a part-load operation of the engine.

18. The method of claim 17, further including controlling the control sleeve to substantially block said at least one sleeve port of at least one piston sleeve to substantially block fluid flow from the area containing low pressure fluid to the pumping chamber during said retracting stroke to correspond with an idle operation of the engine.

19. A hydraulically actuated system, comprising:

a pump including a rotating shaft, a plurality pistons, and a plurality of control sleeves, each piston at least partially, slidably contained within a respective piston sleeve, the pistons being operably coupled to the rotating shaft such that rotation of the shaft reciprocates the pistons, each control sleeve being slidable relative to a respective one of said piston sleeves and being operable to selectively vary the amount of fluid delivered by the pump;

a high pressure rail fluidly coupled with the pump;

at least one hydraulically actuated fuel injector connected to the high pressure rail; and an electronic control module configured to control said control sleeves.

20. The hydraulically actuated system according to claim 19, wherein the electronic control module is configured to control said control sleeves in response to a sensed pressure at the high pressure rail.

* * * * *